US008220898B2

(12) United States Patent
Ito

(10) Patent No.: US 8,220,898 B2
(45) Date of Patent: Jul. 17, 2012

(54) METHOD FOR INSPECTING DROPLET DISCHARGE HEAD, DEVICE FOR INSPECTING DROPLET DISCHARGE HEAD, AND DROPLET DISCHARGE DEVICE

(75) Inventor: Yoshihiro Ito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 246 days.

(21) Appl. No.: 12/716,870

(22) Filed: Mar. 3, 2010

(65) Prior Publication Data

US 2010/0238228 A1 Sep. 23, 2010

(30) Foreign Application Priority Data

Mar. 18, 2009 (JP) ..... 2009-065724

(51) Int. Cl.
*B41J 29/393* (2006.01)

(52) U.S. Cl. ..... 347/19; 347/14

(58) Field of Classification Search ..... 347/14, 347/15, 19
See application file for complete search history.

(56) References Cited

U.S. PATENT DOCUMENTS 7,980,650 B2 * 7/2011 Zhang et al. ..... 347/19

FOREIGN PATENT DOCUMENTS

JP 2005-14216 A 1/2005

* cited by examiner

*Primary Examiner* — Juanita D Jackson
(74) *Attorney, Agent, or Firm* — Global IP Counselors, LLP

(57) ABSTRACT

A method for inspecting a droplet discharge head includes generating illuminating light based on a color tone of a dot pattern of a droplet discharged from the droplet discharge head by selecting at least one of a plurality of illuminating light sources of different color tones and by modulating light illuminated from the at least one of the illuminating light sources based on the color tone of the dot pattern, capturing an image of the dot pattern while a photographed region including the dot pattern is being illuminated by the illuminating light, and inspecting the image of the dot pattern using image processing.

7 Claims, 7 Drawing Sheets

METHOD FOR INSPECTING DROPLET DISCHARGE HEAD, DEVICE FOR INSPECTING DROPLET DISCHARGE HEAD, AND DROPLET DISCHARGE DEVICE

CROSS-REFERENCE TO RELATED APPLICATIONS

This application claims priority to Japanese Patent Application No. 2009-065724 filed on Mar. 18, 2009. The entire disclosure of Japanese Patent Application No. 2009-065724 is hereby incorporated herein by reference.

BACKGROUND

1. Technical Field

The present invention relates to a method for inspecting a droplet discharge head, a device for inspecting a droplet discharge head, and a droplet discharge device.

2. Related Art

Electro-optic devices are currently being manufactured using inkjet-type droplet discharge devices. Examples of electro-optic devices include liquid crystal display devices, organic EL (electro luminescence) devices, and other devices that use color filters. When these electro-optic devices are manufactured using a droplet discharge device, droplets must be discharged (dripped) in a predetermined amount with extreme accuracy from a droplet discharge head to a predetermined position on a discharge target.

Japanese Laid-Open Patent Application No. 2005-14216 discloses an invention of a method and device for inspecting a dot pattern of droplets discharged from a nozzle of a droplet discharge head. The invention of Japanese Laid-Open Patent Application No. 2005-14216 is wherein a plurality of dot patterns formed in alignment on an object to be inspected is photographed and an electronic image acquired by photographing is subjected to image processing, whereby the intervals between adjacent dot patterns are measured and the measured values are compared with a regular value, allowing positional misalignment of the dot patterns to be detected.

SUMMARY

When the dot patterns are photographed, an illumination device is used to illuminate the photographed area in order to accurately acquire images of the shapes of the dot patterns. White light, for example, is often used as the illuminating light emitted by this illumination device. Specifically, since white light is colorless (strictly speaking, is only slightly colored) and does not acquire a color tone in any of the color regions red (R), green (G), or blue (B), it is possible to use monochromatic light to enhance the contrast between the object being inspected (usually white paper) and each dot pattern of functional liquid droplets containing red, green, and blue pigments used in the manufacture of color filters, for example.

However, color diversification has recently become common in droplets discharged from droplet discharge heads, and a problem occurs in that the shapes of the dot patterns cannot be accurately acquired through imaging, depending on the color tone of the droplets. Dot patterns of droplets containing yellow, magenta, cyan, and other pigments having light, pale color tones represent a fitting example. This leads to cases in which sufficient contrast cannot be obtained by illumination with white light, adequate contrast cannot be obtained for electronic image despite the fact that dot patterns have been photographed, and inspection using image processing cannot be performed appropriately.

The present invention was devised in view of the problems described above, and an object thereof is to provide a method for inspecting a droplet discharge head, a device for inspecting a droplet discharge head, and a droplet discharge device whereby dot patterns having a predetermined color tone can be appropriately inspected using image processing.

In order to solve the problems described above, a method for inspecting a droplet discharge head according to a first aspect includes generating illuminating light based on a color tone of a dot pattern of a droplet discharged from the droplet discharge head by selecting at least one of a plurality of illuminating light sources of different color tones and by modulating light illuminated from the at least one of the illuminating light sources based on the color tone of the dot pattern, capturing an image of the dot pattern while a photographed region including the dot pattern is being illuminated by the illuminating light, and inspecting the image of the dot pattern using image processing.

Using the method according to the first aspect makes it possible to select the illuminating light source to be used based on the color tone of the photographed dot patterns, and to generate illuminating light suited to the color tone of the dot patterns by modulating the light of the illuminating light source. Therefore, the dot patterns of the photographed target can be photographed with a high contrast.

In the method according to a second aspect, the generating of the illuminating light preferably includes selecting at least two of the illuminating light sources and combining lights from the at least two of the illuminating light sources to generate the illuminating light based on the color tone of the dot pattern.

Using the method according to the second aspect makes it possible to generate illuminating light suited to the color tone of the dot patterns by combining illuminating light of different color tones. Therefore, there is no need to provide an illuminating light source for each color tone, the number of illuminating light sources that need to be installed can be reduced, costs can be curtailed, and space can be conserved.

In the method according to a third aspect, the generating of the illuminating light preferably includes selecting the at least one of the illuminating light sources including an illuminating light source of red light, an illuminating light source of green light, and an illuminating light source of blue light.

Using the method according to the third aspect makes it possible to generate illuminating light of various color tones by using light of the three primary colors.

In the method according to a fourth aspect, the generating of the illuminating light preferably includes generating the illuminating light in a color tone that is complementary to the color tone of the dot pattern.

By using the method according to the fourth aspect, illuminating light is generated in a color that is complementary to the color tone of the dot patterns in the color circle, whereby the dot patterns of the photographed target can be photographed with the highest possible contrast.

A device for inspecting a droplet discharge head according to a fifth aspect includes a plurality of illuminating light sources of different color tones, an illuminating light generating device, an imaging device and an inspecting device. The illuminating light generating device is configured to generate illuminating light based on a color tone of a dot pattern of a droplet discharged from the droplet discharge head by selecting at least one of the illuminating light sources and by modulating light illuminated from the at least one of the illuminating light sources based on the color tone of the dot pattern. The imaging device is configured and arranged to capture an image of the dot pattern while a photographed region including the dot pattern is being illuminated by the illuminating light. The inspecting device is configured to inspect the image of the dot pattern using image processing.

Using the configuration according to the fifth aspect makes it possible to select the illuminating light source to be used based on the color tone of the photographed dot patterns, and to generate illuminating light suited to the color tone of the dot patterns by modulating the light of the illuminating light source. Therefore, the dot patterns of the photographed target can be photographed with a high contrast.

A droplet discharge device according to another aspect includes the device for inspecting a droplet discharge head as described above.

BRIEF DESCRIPTION OF THE DRAWINGS

Referring now to the attached drawings which form a part of this original disclosure.

DETAILED DESCRIPTION OF EXEMPLARY EMBODIMENTS

The following is a description, made with reference to the accompanying drawings, of an embodiment of a method for inspecting a droplet discharge head, a device for inspecting a droplet discharge head, and a droplet discharge device having this device, all according to the present invention. The droplet discharge device of the present embodiment is installed in a drawing system incorporated in a manufacturing line for electro-optic devices, wherein specialized ink, a luminescent resin liquid, or another functional liquid is introduced into a droplet discharge head, and a film is formed on a substrate.

Figure 1:
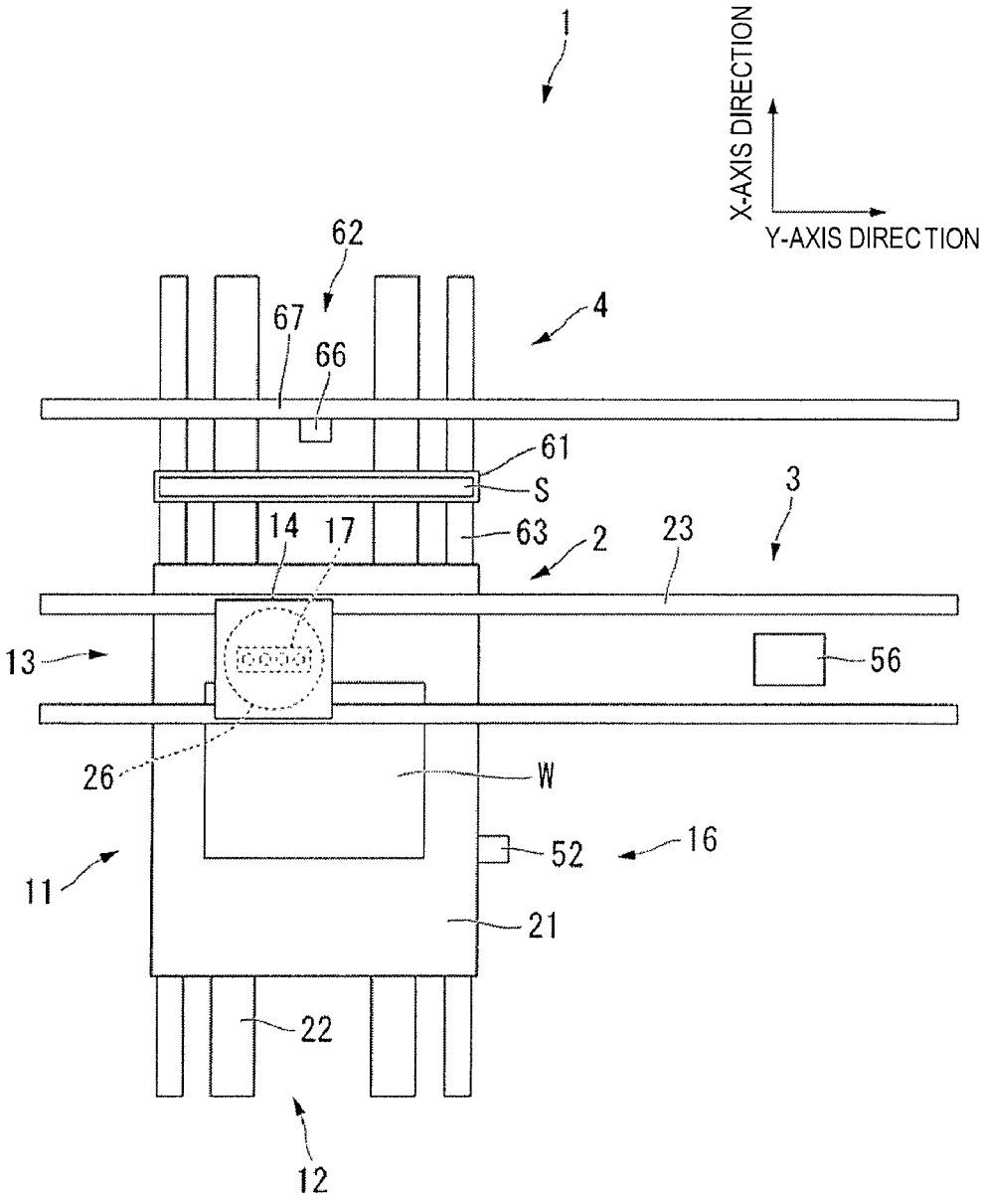
FIG. 1 is a schematic plan view of a droplet discharge device according to an embodiment of the present invention.
Figure 2:
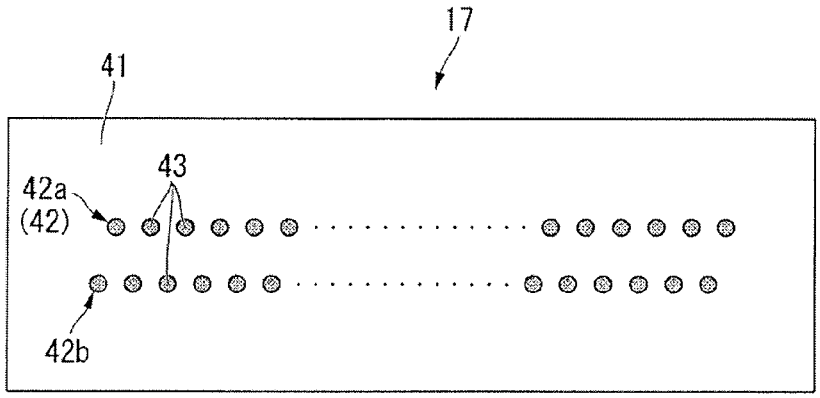
FIG. 2 is a schematic view of a functional liquid droplet discharge head according to an embodiment of the present invention as seen from the side of the nozzle surface.
Figure 3:
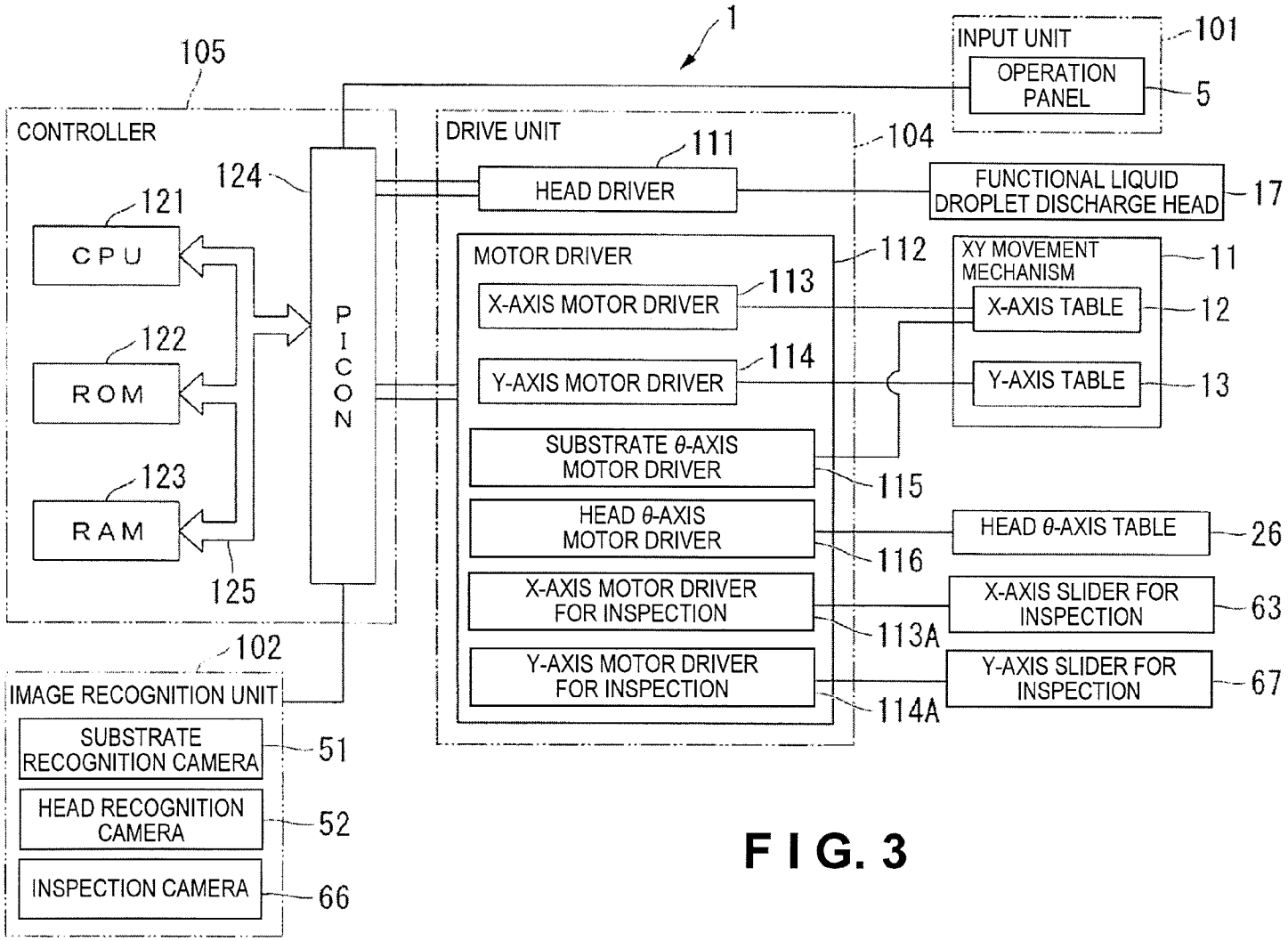
FIG. 3 is a block diagram showing the control system of the droplet discharge device according to an embodiment of the present invention.
Figure 4:
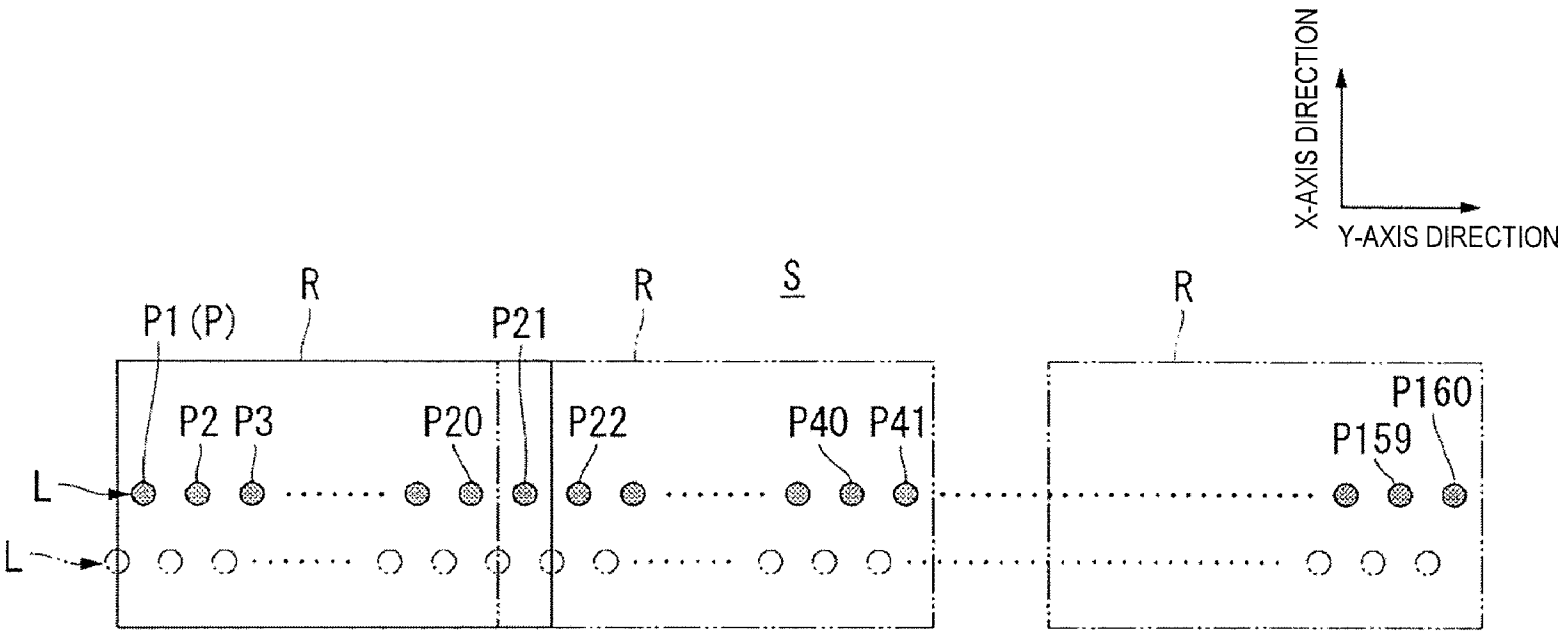
FIG. 4 is a schematic plan view showing the inspection area of an inspection camera according to an embodiment of the present invention.
Figure 5:
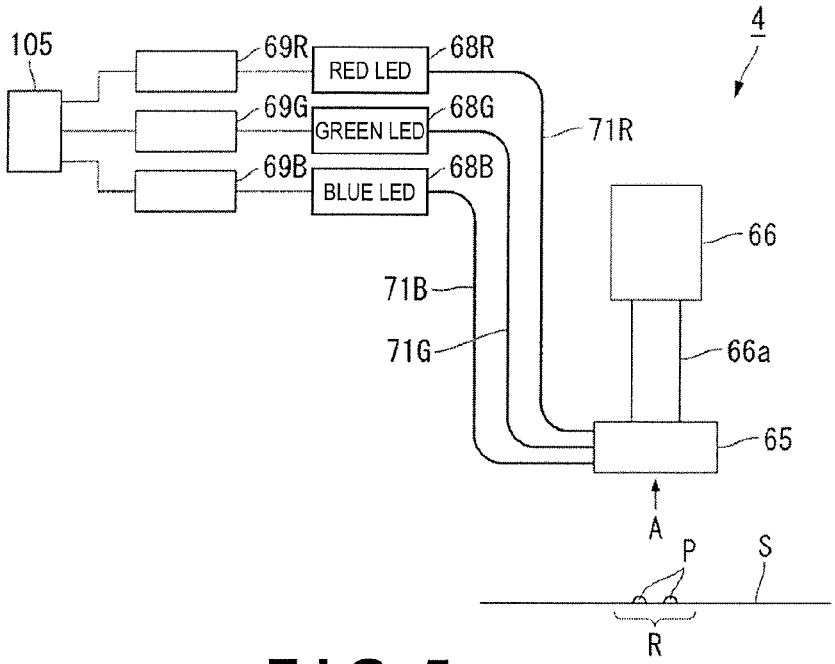
FIG. 5 is a schematic plan view showing the configuration of a discharge inspection unit according to an embodiment of the present invention.
Figure 6:
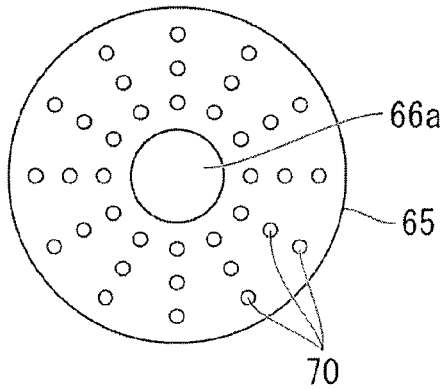
FIG. 6 is a view indicated by the arrow A in FIG. 5.

FIG. 1 is a schematic plan view of a droplet discharge device according to an embodiment of the present invention. FIG. 2 is a schematic view of a functional liquid droplet discharge head as seen from the side of the nozzle surface. FIG. 3 is a block diagram showing the control system of the droplet discharge device. FIG. 4 is a schematic plan view showing the inspection area of an inspection camera. FIG. 5 is a schematic side view showing the configuration of the discharge inspection unit. FIG. 6 is a view indicated by arrow A in FIG. 5.

A droplet discharge device 1 has a drawing device 2 having a plurality of functional liquid droplet discharge heads (droplet discharge heads) 17, a maintenance device 3 provided to the drawing device 2, and a discharge inspection unit (inspection device) 4 for performing discharge inspection on the functional liquid droplet discharge heads 17, as shown in FIG. 1. The droplet discharge device 1 also has an operation panel 5 for inputting various data, and a controller (illuminating light generating device and inspecting device) 105 for collectively controlling all components as shown in FIG. 3. In FIG. 1, only one functional liquid droplet discharge head 17 is shown for the sake of simplicity.

The droplet discharge device 1 is configured to perform, under the control of the controller 105, a maintenance process for maintaining or restoring the discharge function of the functional liquid droplet discharge heads 17 by using the maintenance device 3, a functional liquid droplet discharge head inspection process for inspecting the dot pattern of the functional liquid droplet discharge heads 17 by using the discharge inspection unit 4, and an actual drawing process for discharging and depositing functional liquid droplets onto a substrate W (workpiece for actual drawing) by using the drawing device 2.

The drawing device 2 has an XY movement mechanism 11 composed of an X-axis table 12 for moving the substrate W in an X-axis direction, and a Y-axis table 13 for moving a carriage 14, which carries the functional liquid droplet discharge heads 17, in a Y-axis direction orthogonal to the X-axis direction.

The area of intersection between the trajectory of movement of the substrate W by the X-axis table 12 and the trajectory of movement of the carriage 14 by the Y-axis table 13 is the drawing area where the actual drawing process is performed. The area (to the right in the drawing) outside of the X-axis table 12 on the trajectory of movement of a head unit 15 by the Y-axis table 13 is a maintenance area. Part of the maintenance device 3 is disposed in this maintenance area. The area in front of the X-axis table 12 is a substrate loading/unloading area for loading and unloading the substrate W to and from the droplet discharge device 1.

The X-axis table 12 has a positioning table 21 for positioning the substrate W, and a drawing X-axis slider 22 for supporting the positioning table 21 and sliding the positioning table in the X-axis direction.

The positioning table 21 is equipped with a vacuum-suction table for positioning the substrate W by vacuum suction, a substrate θ-axis table for finely adjusting the θ position of the substrate W, and other components. The drawing X-axis slider 22 is driven by an X-axis motor driver 113 (see FIG. 3) constituting an X-axis direction drive system.

The Y-axis table 13 is designed to straddle the X-axis table 12 and is supported by left and right support rods (not shown) set up on the floor. The Y-axis table has the carriage 14 is mounted with the functional liquid droplet discharge heads 17, and a drawing Y-axis slider 23 for supporting the carriage 14 and sliding the carriage in the Y-axis direction.

The carriage 14 has a head θ-axis table 26 for holding the plurality of functional liquid droplet discharge heads 17 and correcting the θ-position of the heads. In the present embodiment, there is only one carriage 14, but any desired number of carriages can be used. The drawing Y-axis slider 23 is driven by a Y-axis motor driver 114 (see FIG. 3) constituting a Y-axis direction drive system.

The droplet discharge device 1 of the present embodiment is capable of discharging functional liquid droplets of numerous color tones including cyan (C), magenta (M), and yellow (Y) in addition to red (R), green (G), and blue (B); and is provided with a predetermined number of functional liquid droplet discharge heads 17 in accordance with the color tones.

The functional liquid droplet discharge heads 17 are supplied with a functional liquid from a functional liquid pack or the like (not shown), and the heads then discharge the functional liquid through an inkjet system (e.g., driven by a piezoelectric element), as shown in FIG. 2. The functional liquid droplet discharge heads 17 each have two nozzle rows 42 (nozzle rows 42*a*, 42*b*) formed in parallel to each other on a nozzle surface 41.

The length of each nozzle row 42 is 1 inch (about 25.4 mm), for example, and each nozzle row 42 is configured with 180 nozzles 43 aligned at a regular pitch (about 140 μm). The distance between two nozzle rows 42 is about 2.2 mm, for example.

In the internal flow channel structures of the heads, the amounts discharged from the nozzles 43 placed at the ends are greater than the amounts discharged from the nozzles 43 placed in the center. Therefore, the ten nozzles 43 at the ends are designated as non-discharge nozzles while the 160 nozzles 43 in the center are designated as discharge nozzles, the functional liquid is discharged only from the discharge nozzles, and functional liquid is not discharged from the non-discharge nozzles.

Referring back to FIG. 1, the droplet discharge device 1 has an alignment device 16. The alignment device 16 has a substrate recognition camera 51 (see FIG. 3) for imaging and recognizing alignment marks (not shown) for the substrate W, and a head recognition camera 52 (see FIGS. 1 and 3) for imaging and recognizing alignment marks (not shown) for the functional liquid droplet discharge heads 17.

In the maintenance area, the maintenance device 3 has a suction unit 56 for suctioning the functional liquid from the nozzles 43 of the functional liquid droplet discharge heads 17, a wiping unit (not shown) for wiping down the nozzle surface 41 of the functional liquid droplet discharge heads 17, a splatter monitoring unit (not shown) for monitoring the splattering of the functional liquid droplets, and other components.

The discharge inspection unit 4 has a drawn unit 61 whereby inspection roll paper (workpiece being inspected) S provided with a dot-pattern row L (see FIG. 4) designed for inspection and created by the functional liquid droplet discharge heads 17 is pulled out in the Y-axis direction, and an inspection photographing unit 62 for photographing the dot-pattern row L.

The discharge inspection unit 4 creates an image and recognizes the drawn result of the dot-pattern row L formed by the functional liquid droplet discharge heads 17, and inspects whether or not the functional liquid droplets have been properly discharged from the nozzles 43.

The drawn unit 61 has an inspection X-axis slider 63 for moving the inspection roll paper S in the X-axis direction, and a winding mechanism (not shown) for winding up the inspection roll paper S.

The inspection X-axis slider 63 is provided independently of the drawing X-axis slider 22 and is driven by an inspection X-axis motor driver 113A (see FIG. 3) constituting an X-axis direction drive system. In the present embodiment, the drawn unit 61 and the positioning table 21 are mounted on separate X-axis sliders, but they may also be mounted on the same X-axis slider.

The winding mechanism is configured to cause the undrawn area to face the nozzle surface 41 of the functional liquid droplet discharge heads 17 by winding up a predetermined length (e.g., 50 m) of the inspection roll paper S in the Y-axis direction. This winding is performed with each functional liquid droplet discharge head inspection process, for example.

The inspection roll paper S is white inspection paper wound up into the shape of a roll, and has a base material layer and a receiving layer that is formed (coated) over the surface of the base material layer and can be penetrated by functional liquid droplets.

The inspection roll paper S has a width (e.g., 100 mm) corresponding to a plurality of inspection drawings. The inspection roll paper S also has a predetermined length (e.g., 50 m) intended to reduce the frequency of replacing paper.

The workpiece designed for inspection and subject to the discharge of the functional liquid droplet discharge heads 17 is not limited to the inspection roll paper S, and may also be a strip of inspection paper, for example. The frequency of replacing paper can be reduced, however, by using a roll of inspection paper. Furthermore, although it requires a cleaning process, a glass substrate can be used.

The inspection photographing unit 62 has an inspection camera 66 (imaging device) for capturing an image of a dot pattern L (drawing result) drawn on the inspection roll paper S, and an inspection Y-axis slider 67 for moving the inspection camera 66 in the Y-axis direction.

The inspection camera 66 has predetermined inspection regions R (photographed regions) as shown in FIG. 4. The inspection camera 66 is a high-resolution (narrow-viewing-angle) CCD (charge-coupled-device) camera, and is configured to be capable of producing photographs that contain a plurality of dot-pattern rows L.

The inspection Y-axis slider 67 is provided independently of the drawing Y-axis slider 23 and is driven by an inspection Y-axis motor driver 114A (see FIG. 3) constituting a Y-axis direction drive system.

The discharge inspection unit 4 of the present embodiment is configured to move the inspection regions R of the inspection camera 66 in the direction of alignment of the dot-pattern rows L (in the Y-axis direction in FIG. 4) to acquire a plurality of images, and to inspect the dot-pattern rows L while connecting the images.

Specifically, when functional liquid droplets are discharged in a single cycle from the nozzle rows 42 of the functional liquid droplet discharge heads 17 to form dot-pattern rows L on the inspection roll paper S, a single dot-pattern row L contains 160 dot patterns P (P1 to P160). Twenty-one dot patterns P are photographed for each image, and the images are connected so that the twenty-first (final) dot pattern P21 of these patterns is also the first dot pattern P of the next image. Specifically, 20 (dots)×8 (images)=160 (dots), and one dot-pattern row L can be inspected with a total of eight images. For the inspection, predetermined inspection values based on the shape of the dot patterns P are sequentially acquired and inspected using image processing. These inspection values include the surface area of the dot patterns P, the barycentric position (coordinate position), and other values.

The inspection camera 66 has an illumination device 65 mounted around the distal end of a high-power lens 66*a* and used to emit illuminating light onto an inspection region R, as shown in FIG. 5.

The illumination device 65 has a red LED (Light Emitting Diode (illuminating light source)) 68R, a green LED (illuminating light source) 68G, and a blue LED (illuminating light source) 68B. The illumination device 65 has an LED power source 69R for supplying electricity to the red LED 68R, an LED power source 69G for supplying electricity to the green LED 68G, and an LED light source 69B for supplying electricity to the blue LED 68B. The LED light sources 69R, 69G, and 69B are all driven under the control of the controller 105. For example, the illumination device 65 has a configuration in which the controller 105 can adjust the luminosity of the illuminating light, combine the illuminating light beams, emit an electronic flash, and perform other functions.

Light-emitting parts 70 of the illumination device 65 shown in FIG. 6 are connected with the red LED 68R, the green LED 68G, and the blue LED 68B via an optic fiber 71R, an optic fiber 71G, and an optic fiber 71B. Illuminating light, modulated after being selected from the red LED 68R, the green LED 68G, and the blue LED 68B, is emitted onto the inspection region R from the light-emitting parts 70 under the control of the controller 105. The light-emitting parts 70 are provided at predetermined intervals in the periphery of the high-power lens 66*a*, and are configured to be capable of uniformly illuminating the inspection region R. The light-emitting parts 70 may be configured to emit light of only a predetermined LED, and they may also be configured to combine and emit light from a plurality of LEDs.

Next, the control system of the entire droplet discharge device 1 will be described with reference to FIG. 3. The control system of the droplet discharge device 1 essentially has an input unit 101 having the operation panel 5 for inputting various data; an image recognition unit 102 having various cameras provided to the alignment device 16 and the discharge inspection unit 4; a drive unit 104 having various drivers for driving the functional liquid droplet discharge heads 17, the XY movement mechanism 11, and other components; and the controller 105 for collectively controlling the droplet discharge device 1, including these components.

The drive unit 104 has a head driver 111 for controlling the discharge driving of the functional liquid droplet discharge heads 17, and a motor driver 112 for drivably controlling the motors of the XY movement mechanism 11 and other components. The head driver 111 generates and applies a predetermined drive waveform in accordance with an instruction from the controller 105, and controls the discharge driving of the functional liquid droplet discharge heads 17. The motor driver 112 has the X-axis motor driver 113, the Y-axis motor driver 114, a substrate θ-axis motor driver 115, a head θ-axis motor driver 116, the inspection X-axis motor driver 113A, and the inspection Y-axis motor driver 114A. These drivers drivably control the drive motors of the X-axis table 12, the Y-axis table 13, the substrate θ-axis table, the head θ-axis table 26, the inspection X-axis slider 63, and the inspection Y-axis slider 67 in accordance with instructions from the controller 105.

The controller 105 has a CPU 121, a ROM 122, a RAM 123, and a P-CON 124, which are all connected to each other via a bus 125. The ROM 122 has a control program region for storing control programs and the like processed by the CPU 121, and a control data region for storing control data and the like for performing the actual drawing process and image recognition.

In addition to various register groups, the RAM 123 has a drawing data region for performing the actual drawing process, a discharge inspection data region for performing the functional liquid droplet discharge head inspection process, an image data region for temporarily storing image data, and other regions; which are used as various operating regions for the control process.

The P-CON 124 is configured with a logic circuit for supplementing the function of the CPU 121 and handling interface signals with the peripheral circuitry. Therefore, the P-CON 124 introduces image data, various instructions from the input unit 101, or the like into the bus 125 either directly or after processing, and, operating in cooperation with the CPU 121, outputs data or control signals inputted to the bus 125 from the CPU 121 or the like to the drive unit 104 either directly or after processing.

After inputting various detection signals, various instructions, various data, and the like via the P-CON 124 in accordance with a control program in the ROM 122 and processing the various data and the like in the RAM 123, the CPU 121 controls the entire droplet discharge device 1 by outputting various control signals to the drive unit 104 and other components via the P-CON 124.

For example, the CPU 121 controls the functional liquid droplet discharge heads 17, the X-axis table 12, and the Y-axis table 13 to draw patterns on the substrate W under predetermined droplet discharge conditions and predetermined movement conditions.

A simple description is given herein of a series of actual drawing processes performed on the substrate W by the droplet discharge device 1. First, the substrate W is set on the positioning table 21 which has been moved to the substrate loading/unloading area, and a substrate alignment process is performed based on the results provided by the substrate recognition camera 51 in recognizing the image of substrate alignment as a preparation prior to the discharge of functional liquid droplets.

The functional liquid droplets are discharged while the functional liquid droplet discharge heads 17 are moved relative to the substrate W. Specifically, main scanning, in which functional liquid droplets are discharged and deposited from the plurality of functional liquid droplet discharge heads 17 onto the substrate W while the substrate W is moved in the X-axis direction by the X-axis table 12, and sub scanning, in which the head unit 15 is moved in the Y-axis direction by the Y-axis table 13, are performed repeatedly, and functional liquid droplets are discharged (drawn) over the entire substrate W.

Figure 7:
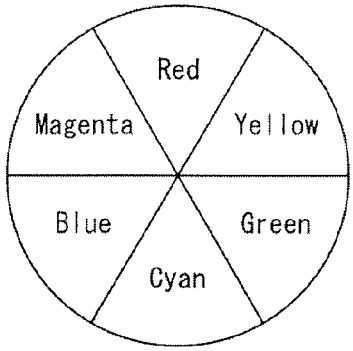
FIG. 7 is a schematic view showing the color circle.
Figure 8A:
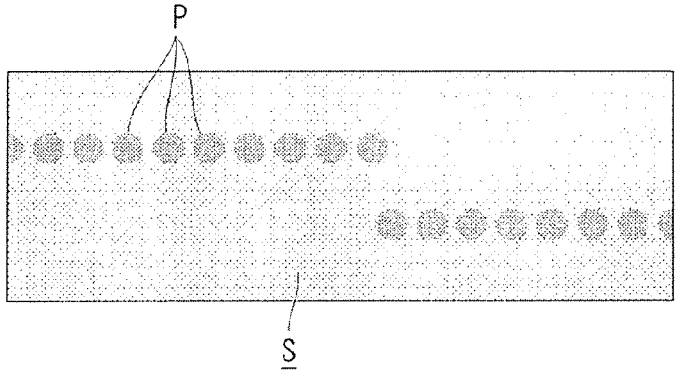
FIGS. 8(*a*)-8(*c*) is a drawing showing the images obtained when yellow dot patterns formed on an inspection roll paper in an embodiment of the present invention are illuminated with (a) white light, (b) blue light, and (c) red light.
Figure 8B:
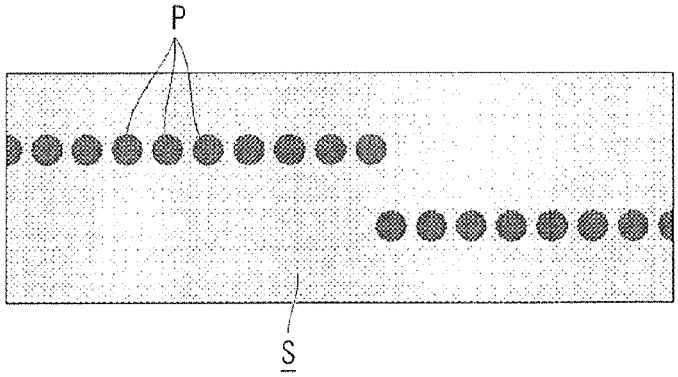
Figure 8C:
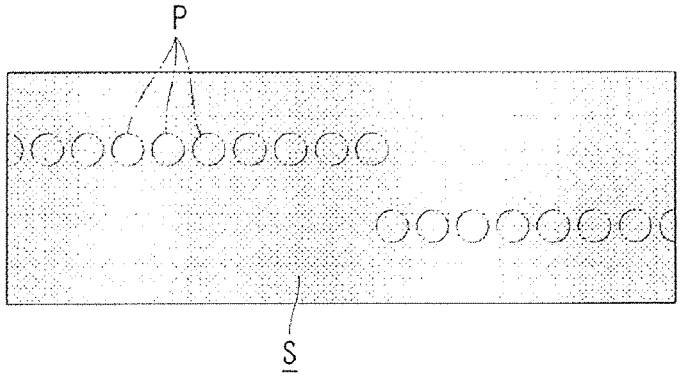

The following is a detailed description, made with reference to FIGS. 7 and 8, of the functional liquid droplet discharge head inspection process (method for inspecting the functional liquid droplet discharge heads) of the discharge inspection unit 4.

FIG. 7 is a schematic view showing the color circle. FIGS. 8(*a*)-8(*c*) are drawings showing the images obtained when yellow dot patterns P formed on an inspection roll paper S are illuminated with (a) white light, (b) blue light, and (c) red light. The following description presents an example of a functional liquid droplet discharge head inspection process performed on functional liquid droplet discharge heads 17 for discharging functional liquid droplets containing a yellow pigment.

The functional liquid droplet discharge head inspection process is performed before and after the actual drawing process described above, wherein the discharge state of the nozzles 43 of the functional liquid droplet discharge heads 17 is inspected. In cases in which no deviations from normal operation are confirmed in the nozzles 43 by the functional liquid droplet discharge head inspection process, the next actual drawing process is then performed; and in cases in which a deviation from normal operation is confirmed, a maintenance process is performed on the functional liquid droplet discharge heads 17 before the next actual drawing process is performed.

In the present process, the controller 105 first causes the functional liquid droplet discharge heads 17 and the inspection roll paper S to face each other. The controller 105 then causes functional liquid droplets to be discharged onto the inspection roll paper S from the nozzle rows 42, forming dot patterns P for inspection.

Next, in the present process, the controller 105 produces a contrast between the dot patterns P for inspection and the inspection roll paper S, and generates, based on the color tone of the dot patterns P, illuminating light capable of appropriately performing subsequent image processing (illuminating light generation step).

In the present embodiment, the controller 105 selects the color tone of the contrast-enhancing illuminating light based on the color tone of the dot patterns P of the inspected target and data on the color wheel shown in FIG. 7. The color blue is selected here as a color that is complementary (opposite) to yellow on the color wheel in order to photograph the dot patterns P with the highest possible contrast.

Next, the controller 105 selects the blue LED 68B from among the plurality of LEDs in order to generate the selected color. Specifically, the controller 105 causes only the LED light source 69B shown in FIG. 5 to be driven. When the LED power source 69B is driven, the blue LED 68B emits light, and the blue light is guided to the light-emitting parts 70 via the optic fiber 71B. The blue illuminating light emitted from the light-emitting parts 70 illuminates the inspection region R in a uniform manner.

The controller 105 moves the inspection camera 66 mounted with the illumination device 65 for emitting blue light, and acquires an image of the inspection region R that includes the leftmost end dot pattern P of the dot pattern row L. Under the control of the controller 105, the discharge inspection unit 4 uses image processing to acquire the surface areas of the dot patterns P, the barycentric positions (coordinate positions), and other inspection values in a sequence that starts with the dot pattern P position at one end (the leftmost end) of the dot-pattern row L.

After the image has been inspected, the controller 105 causes the inspection camera 66 to make a transition and acquire an image of the next inspection region R, and connects both images based on the coordinates of the dot pattern P (e.g., the dot pattern P21) for image connection. The dot pattern P at the rightmost end of the dot pattern row L is then inspected.

In the image acquired in the process described above, the contrast between the yellow dot patterns P and the inspection roll paper S illuminated with blue light is clearly manifested, as shown in FIG. 8(*b*). It is therefore possible to create an image of the dot patterns P by image recognition, and the dot patterns P can be accurately inspected.

FIG. 8(*a*) shows the acquired image when white light is used, but the contrast in the yellow dot patterns P is not clearly manifested with white light, and the contours of the dot patterns P are light in color and blurred. An image process cannot be appropriately performed in this case.

FIG. 8(*c*) shows an acquired image when red light is used, but since yellow and red are in adjacent regions on the color wheel, contrast is not manifested in yellow dot patterns P with red light, and the dot patterns P disappear from the acquired image. The image processing is not possible in this case.

In cases in which the dot patterns P have a color tone other than yellow, the controller 105 uses data on the color wheel shown in FIG. 7, and causes the illumination device 65 to emit light of the optimum color tone in each case.

For example, when the dot patterns P have a cyan color tone, the red LED 68R is selected and red illuminating light is emitted. When the dot patterns P have a magenta color tone, the green LED 68G is selected and green illuminating light is emitted.

When the dot patterns P have a red color tone, for example, the green LED 68G and the blue LED 68B are selected to create cyan, and composite light of that color is emitted. When the dot patterns P have a green color tone, the red LED 68R and the blue LED 68B are selected to create magenta, and composite light of that color is emitted. When the dot patterns P have a blue color tone, the red LED 68R and the green LED 68G are selected to create yellow, and composite light of that color is omitted.

The controller 105 adjusts, in accordance with the color tone of the dot patterns P, the specifications (luminosity and the like) of the light emitted by the illumination device 65. Green light is optimal in cases in which the controller 105 photographs magenta dot patterns P, for example, but when the absolute value of the brightness is low, the controller performs a process such as extending the lighted time of the electronic flash and increasing the luminosity.

Therefore, according to the present embodiment as described above, there is provided a discharge inspection unit 4 which has an inspection camera 66 for photographing dot patterns P of functional liquid droplets having a predetermined color tone discharged from the nozzles 43 of functional liquid droplet discharge heads 17, and an illumination device 65 for emitting illuminating light onto inspection regions R, and which uses image processing to inspect the photographed dot patterns P; wherein the illumination device 65 has a red LED 68R, a green LED 68G, and a blue LED 68B as illuminating light sources of mutually different color tones, and the illumination device 65 uses a configuration having a controller 105 for selecting at least one of the illuminating light sources based on the color tone of the dot patterns P, and modulating the light of the selected illuminating light sources to generate the aforementioned illuminating light, whereby illuminating light suited to the color tone of the dot patterns P can be generated. Therefore, the dot patterns P of the photographed target can be photographed with a high contrast.

Therefore, in the present embodiment, dot patterns P having a predetermined color tone can be appropriately inspected using image processing.

The preferred embodiment of the present invention was described above with reference to the drawings, but the present invention is not limited to this embodiment. The shapes, combinations, and other features of the structural components portrayed in the embodiment described above represent but one example, and various modifications can be made based on the design requirements and the like within a range that does not deviate from the scope of the invention.

For example, in the embodiment described above, the illumination device was described as having illuminating light sources including a red LED, a green LED, and a blue LED, but the present invention is not limited to this configuration alone.

For example, a device obtained by affixing having a color film of a predetermined color tone to a white electric lamp, a white LED, or the like may be used instead. However, since illumination via a color film is low in luminosity, more electricity is needed than in the embodiment described above in order to increase the contrast. This is another reason why it is preferable in terms of energy conservation to used LEDs corresponding to each color as described above.

For example, in the embodiment described above, the dot-pattern row and the next inspection region are photographed by an inspection camera, but the inspection photographing unit may be provided with a drawing observation camera having a high resolution and a narrow viewing angle, and a region camera having a low resolution and a wide viewing angle, and dot-pattern rows may be photographed by the drawing observation camera while inspection regions may be photographed by the region camera.

The present invention can also be applied, for example, to a droplet discharge device for spraying droplets (a liquid substance) in which electrode materials, color materials, and other materials used in the manufacture of liquid crystal displays, EL (electroluminescence) displays, and surface-emitting displays (FEDs) have been dispersed (dissolved) in a predetermined dispersion medium (solvent).

The droplet discharge device may also be a droplet discharge device for spraying a bioorganic substance used in the manufacture of biochips, or a droplet discharge device used as a precision pipette with which droplets are sprayed as specimens.

Furthermore, the device may be a droplet discharge device for spraying lubricating oil on a clock, a camera, or another precision mechanism in pinpoint fashion; a droplet discharge device for spraying an ultraviolet curing resin or another transparent resin liquid onto a substrate in order to form a miniature semispherical lens (optical lens) used in an optical communication element or the like; a droplet discharge device for spraying an acid, an alkali, or another etching liquid in order to etch a substrate or the like; a fluid-spraying device for spraying a gel; or a toner jet recording device for spraying a solid substance, an example of which could be a toner or another powder. The present invention can be applied to any one of these types of droplet discharge devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for inspecting a droplet discharge head comprising:

generating illuminating light based on a color tone of a dot pattern of a droplet discharged from the droplet discharge head by selecting at least two of a plurality of illuminating light sources of different color tones, by combining lights from the at least two of the illuminating light sources, and by modulating the lights illuminated from the at least two of the illuminating light sources based on the color tone of the dot pattern;

capturing an image of the dot pattern while a photographed region including the dot pattern is being illuminated by the illuminating light; and inspecting the image of the dot pattern using image processing.

2. The method for inspecting a droplet discharge head according to claim 1, wherein the generating of the illuminating light includes selecting the at least one of the illuminating light sources including an illuminating light source of red light, an illuminating light source of green light, and an illuminating light source of blue light.

3. The method for inspecting a droplet discharge head according to claim 1, wherein the generating of the illuminating light includes generating the illuminating light in a color tone that is complementary to the color tone of the dot pattern.

4. A device for inspecting a droplet discharge head comprising:

a plurality of illuminating light sources of different color tones;

an illuminating light generating device configured to generate illuminating light based on a color tone of a dot pattern of a droplet discharged from the droplet discharge head by selecting at least two of the illuminating light sources, by combining lights from the at least two of the illuminating light sources, and by modulating the lights illuminated from the at least two of the illuminating light sources based on the color tone of the dot pattern;

an imaging device configured and arranged to capture an image of the dot pattern while a photographed region including the dot pattern is being illuminated by the illuminating light; and an inspecting device configured to inspect the image of the dot pattern using image processing.

5. The device for inspecting a droplet discharge head according to claim 4, wherein the illuminating light sources include an illuminating light source of red light, an illuminating light source of green light, and an illuminating light source of blue light.

6. The device for inspecting a droplet discharge head according claim 4, wherein the illuminating light generating device is configured to generate the illuminating light in a color tone that is complementary to the color tone of the dot pattern.

7. A droplet discharge device including the device for inspecting the droplet discharge head according to claim 4.

* * * * *